United States Patent [19]

Le Gall

[11] 4,046,176

[45] Sept. 6, 1977

[54] WINDING MACHINE FOR CONTINUOUSLY MANUFACTURING CIRCULAR WAVEGUIDES

[75] Inventor: Jean C. Le Gall, Perros-Guirec, France

[73] Assignees: Etat Francais, Issy-les-Moulineaux; Societe Anonyme de Telecommunications, Paris Cedex, both of France

[21] Appl. No.: 600,567

[22] Filed: July 31, 1975

[30] Foreign Application Priority Data

Aug. 2, 1974 France ..... 74.26959

[51] Int. Cl.[2] ..... B21F 3/04

[52] U.S. Cl. ..... 140/92.1; 29/600; 156/432

[58] Field of Search ..... 140/1, 92.1, 115, 149; 242/7.21, 7.23, 47.01, 82; 29/600; 57/9, 93, 97; 156/431, 432, 428; 72/66

[56] References Cited

U.S. PATENT DOCUMENTS

| | | | |
|---|---|---|---|
| 3,769,697 | 11/1973 | Priaroggia et al. | 57/9 |
| 3,796,386 | 3/1974 | Tannert | 242/47.01 |

FOREIGN PATENT DOCUMENTS

| | | | |
|---|---|---|---|
| 859,588 | 12/1952 | Germany | 140/71 |

*Primary Examiner*—Lowell A. Larson

[57] ABSTRACT

Machine for the continuous manufacture of circular waveguides adapted to convey $TE_{01}$ mode electromagnetic waves. The machine comprises a wire winder for winding an insulated metal wire onto a spindle, to provide adjacent turns of the wire winding in peripheral contact with each other a ribbon winder for armoring the wire winding with a ribbon winding and a capstan driver for supporting and centering the spindle and allowing the winding to advance along the spindle. For making the winding fully regular and uniform in spite of variations in the wire diameter, a tensioning device is provided, so that the tension of the wire at the point of winding must be held quite constant. This wire tension at the point of winding depends on the tension of the supplied wire at the winding point of origin and on the reaction of the wound portion, which has already been made. The tension of the supplied wire is made constant by means of an adjustable wire tensioning device which is located on the machine axis and which pulls the wire in a path to describe a cone. Because of this arrangement of the tensioning device, the spindle cannot be mounted onto the machine frame through any supporting members which would interfere or stand in the course or path of the wire. The spindle is immobilized by means of a magnetic clutch. The reaction of the wound portion is made substantially constant by maintaining under compression that portion of the winding which is located between the wire winder and the capstan driver.

2 Claims, 14 Drawing Figures

FIG.10
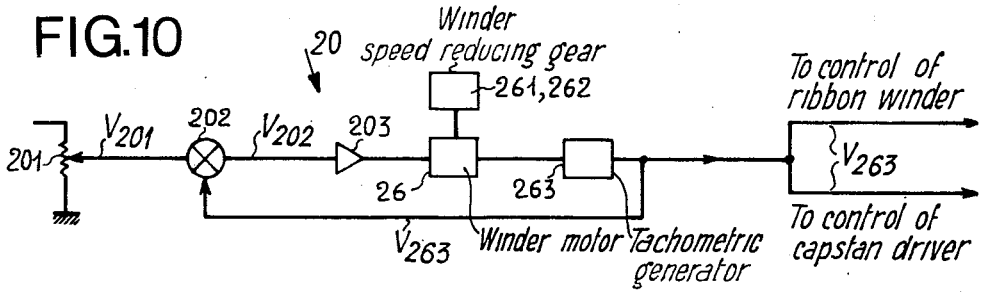
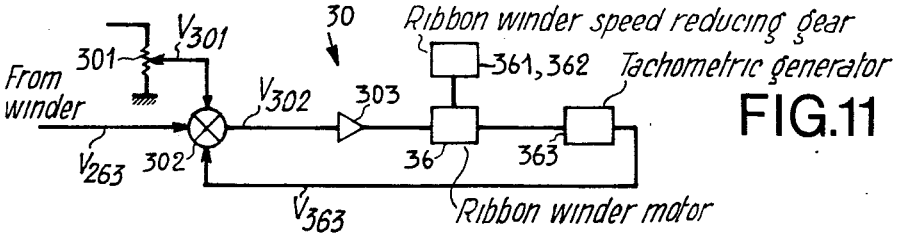
FIG.11
FIG.12
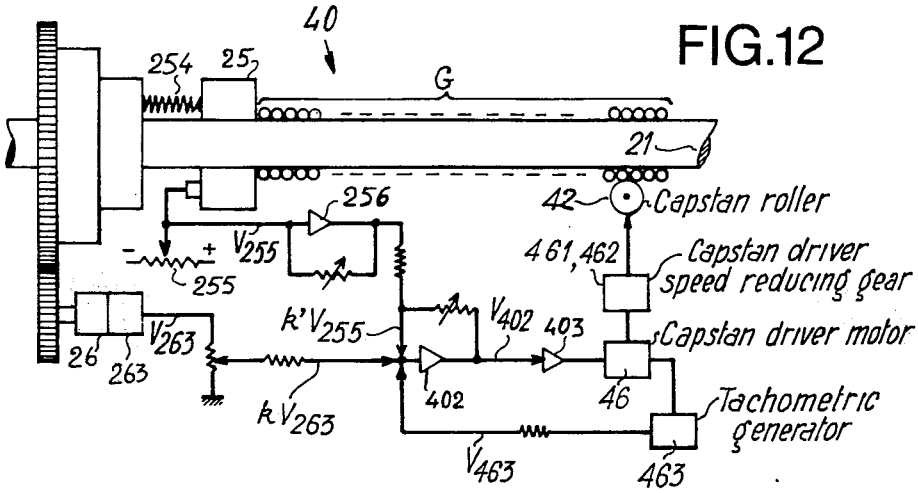

WINDING MACHINE FOR CONTINUOUSLY MANUFACTURING CIRCULAR WAVEGUIDES

CROSS REFERENCE TO RELATED APPLICATIONS

Applicant hereby makes reference to his French Patent Application No. PV 74-26959, filed Aug. 2, 1974 under which priority is claimed in accordance with the provisions of 35 U.S.C. 119.

BACKGROUND OF THE INVENTION

1. Field of the Invention

The present invention concerns a machine for the continuous manufacture of circular waveguide formed by a wound helix of insulated round metal conductor, with adjacent turns of the helix being in peripheral contact.

If a circular guide carrying the $TE_{01}$ mode has a perfect circular geometry, then the propagation of the $TE_{01}$ mode is undisturbed provided the guide walls are made of a homogeneous conductor. One of the most attractive features of such a guide is its low attenuation: the larger the pipe diameter and the higher the frequency, the lower the guide attenuation. Unfortunately the $TE_{01}$ mode is degenerate with the $TM_{11}$ mode and it can be shown that imperfection of the circular geometry brings about a coupling between the two modes, with a consequent loss of power; thus low attenuation is lost.

2. Description of the Prior Art

Machines for manufacturing an indefinite length of circular waveguide by winding an insulated metal wire with adjacent turns in peripheral contact are known in the prior art.

In a first kind of machines, a typical example of which is disclosed in British Pat. No. 887,063 of Mar. 8, 1957, the wire is wound on a rotating spindle so that adjacent turns contact therewith edge-to-edge and the winding is left on the spindle during a time just sufficient for making it rigid and armoring it. The incoming turns are progressively pushed along the spindle by rotating rollers in order to define and make stationary the location of the plane of the first turn of the helix along the spindle. The helix is impregnated with a thermosetting resin or the like and, at a point of the waveguide winding where it has become solid due to the setting of the resin, the diameter of the spindle is decreased either progressively or steppedly or the spindle is cooled with respect to the winding for allowing the winding to be readily removed. If the spindle is mounted in an overhanging relation in respect to the winding, it is possible with these machines to manufacture a circular waveguide in a continuous operation. However these wire winding machines with decreasing spindle diameter do not allow manufacture of large lengths of waveguide per unit of time due to the operating requirement that the waveguide winding must be solidified at the point where the spindle diameter changes to limit the rate of manufacture.

In other machines, a typical example of which is disclosed in French Pat. No. 1,604,891 of Apr. 17, 1972, the spindle is not stepped in diameter and is either rotative or stationary and the insulated conductor wire is wound onto the spindle by means of a rotating carriage carrying the wire supply reel. These rotating carridge winding machines do not lend themselves readily to continuous operation due to the necessity of frequent changing of the empty reels in the rotating carriage and also due to the fact that the moment of inertia of the carriage varies as the reel empties which results in troublesome variation of the wire tension and results in irregularities in winding.

SUMMARY OF THE INVENTION

The applicants have observed that, for obtaining a quite regular turn contacting winding, the wire must be wound onto the spindle under constant tension. The tension of the wire at the starting point of the winding depends upon the tension of the wire at the output of the supply reel and the thrust force of the winder head. This thrust force itself depends on the force of friction of the wire turns against the spindle. As it will be seen in the following, the axial thrust force of the wire winder head is made substantially independent from the friction forces by disposing coaxially and near the winder a capstan driver which drives longitudinally the waveguide although maintaining under compression the section of the same comprised between the winder and the capstan driver. As the compression of the waveguide section depends on the length of the section, the winder head is mounted movable and a control system is provided for keeping constant the distance between the movable head and the capstan driver.

The winder machine of the invention for the manufacture of circular waveguides comprises a wire stretcher mounted on the axis of the machine, an axial spindle, a rotor carriage receiving said wire in an inclined channel provided therein, means for making said axial spindle stationary, a movable winding head, a capstan driver of the wound waveguide and control means for maintaining constant the distance between the movable winding head and the capstan driver.

Due to the fact that the wire describes a cone around the machine axis and to the necessity of allowing for the removal of the waveguide from the spindle, the spindle cannot be carried by the frame of the machine. It is carried by the rotor and it is made stationary by a magnetic clutch.

OBJECT OF THE INVENTION

It is the general object of the present invention to provide a winding machine for the continuous manufacture of circular waveguides from fine wire having a circular geometry structure with a high degree of perfection.

BRIEF DESCRIPTION OF THE DRAWING

Other features and advantages of the invention, in particular concerning the servo-systems, will be evident from the detailed description which follows of a preferred embodiment and on examination of the corresponding attached drawings in which:

FIG. 10 is a diagram of the speed control of the winder;

FIG. 11 is a diagram of the speed control of the ribbon winder; and

FIG. 12 is a diagram of the speed control of the capstan driver.

DESCRIPTION OF THE PREFERRED EMBODIMENT

Figure 1:
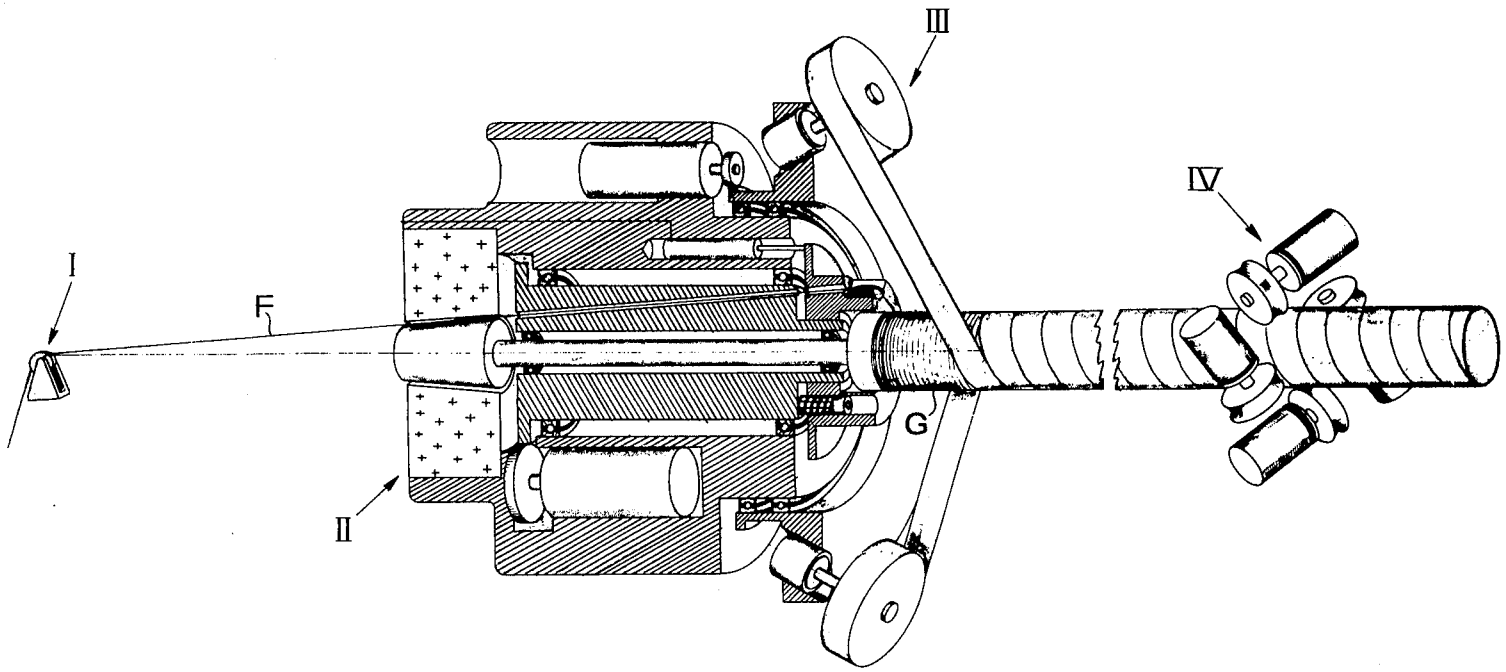
FIG. 1 is a diagrammatic view of a machine according to the invention.

As shown in FIG. 1, a machine according to the invention and capable of being used for the continuous manufacture of a circular wave guide comprises essentially the following sub-units:

a wire stretcher — I
a winder — II
a ribbon winder — III
a capstan driver — IV

Figure 2:
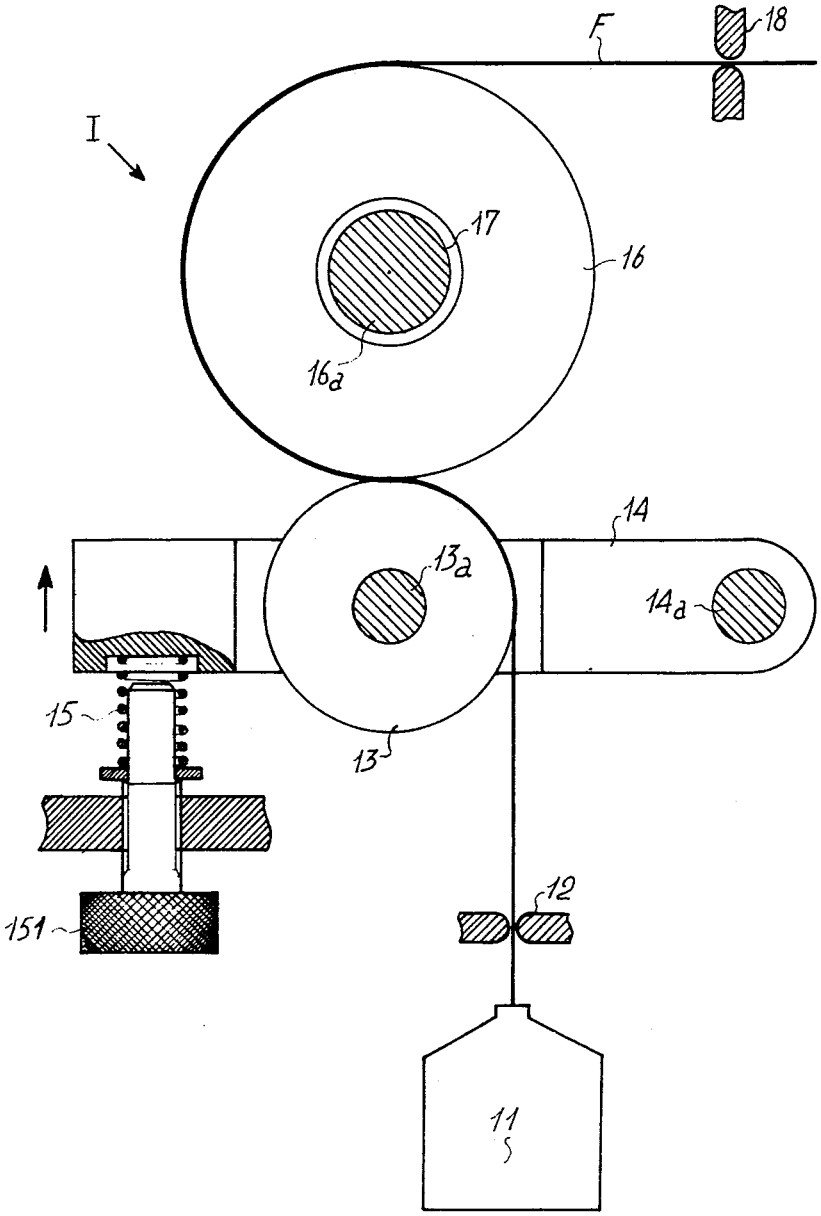
FIG. 2 is a diagrammatic view of the wire stretcher.

The wire stretcher I (see also FIG. 2) has the object of supplying to the rest of the machine insulated copper wire, for instance enamelled copper wire, under constant tension. The stretcher comprises, in the order of progression of the wire, a magazine 11, an anti-ballooning guide wire 12, a variable position whell 13 the horizontal axle 13*a* of which is carried by a lever 14, the single arm of which is mounted pivotably about an axle 14*a* connected to the machine frame and urged at its free end upwards by a compression spring 15, the force of which is adjustable by means of a screw having knurled head 151, a fixed position wheel 16, the axle 16*a* of which is connected to the frame and is provided with an electro-magnetic brake 17, known per se and supplied with a predetermined current and, finally, an outlet wire guide 18. This wire guide 18 is located on the axis of the winding machine.

The wire is pinched between the wheels 13, 16 so that, taking into account the couples and the coefficients of friction, no sliding of the wire of possible; its outlet tension is adjusted by the braking couple exercised by brake 17, this couple itself being directly proportional to the current supplied to the brake.

Figure 3A:
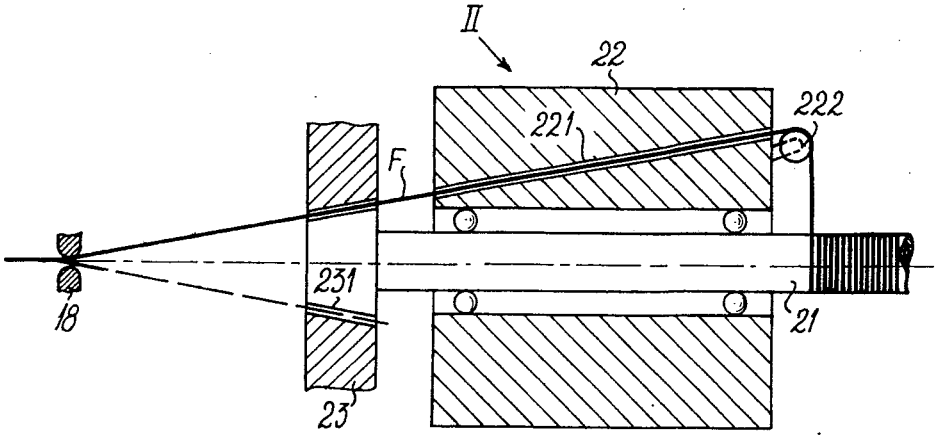
FIGS. 3*a*, 3*b* and 3*c* are diagrammatic views of the winder.

The winder II (see also FIGS. 3*a*, 3*b*) is for winding the wire in turns lying side-by-side around a cylindrical spindle.

It comprises (FIG. 3*a*) a spindle 21 and a rotor 22 mounted co-axially with the spindle so as to be capable of turning around the latter; the rotor is pierced in a radial half-plane by an inclined channel 221, directed in the direction of the aforementioned wire guide 18, itself disposed, as already said, on the geometric axis of the spindle 21. The rotor 22 carries near the end of the channel 221 opposite to the wire guide 18, a return pulley 222 over which the wire passes before winding onto the spindle 21. Under these circumstances, the wire F describes, whilst advancing, a cone with an apex at guide 18, such cone being co-axial with the spindle.

The spindle 21 is fixed, that is to say it is connected to the frame whereby the complications arising from rotating the wave guide as it is being manufactured are avoided. In fact, if the spindle were rotated the great speed of rotation which the manufacture of the continuous wave guide requires, would necessitate the very rapid driving of the ribbon winder and the capstan driver and this would present complex problems. The spindle 21 is in effect integral with a frame element indicated at 23. The cone, however, described by the wire requires cutting off this element 23 along a cone frustrum 231.

Figure 3B:
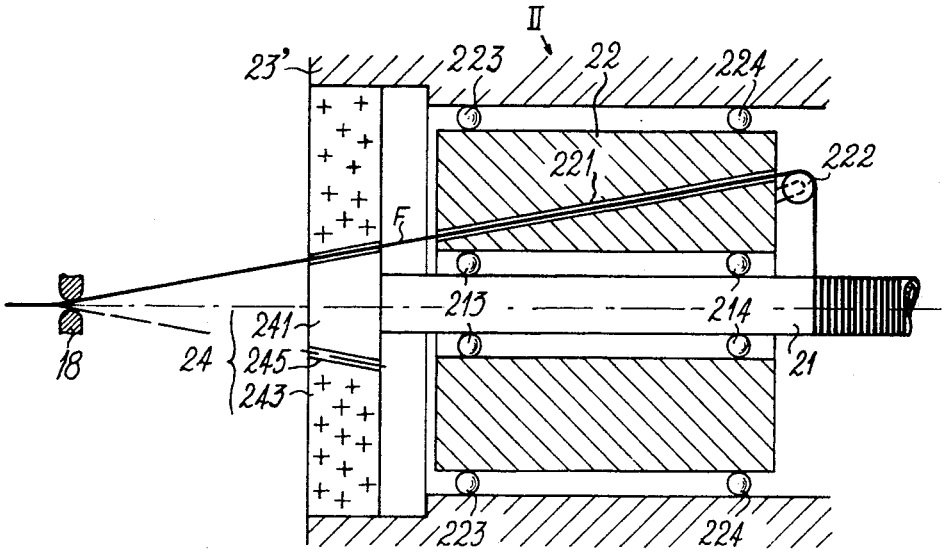
Figure 4:
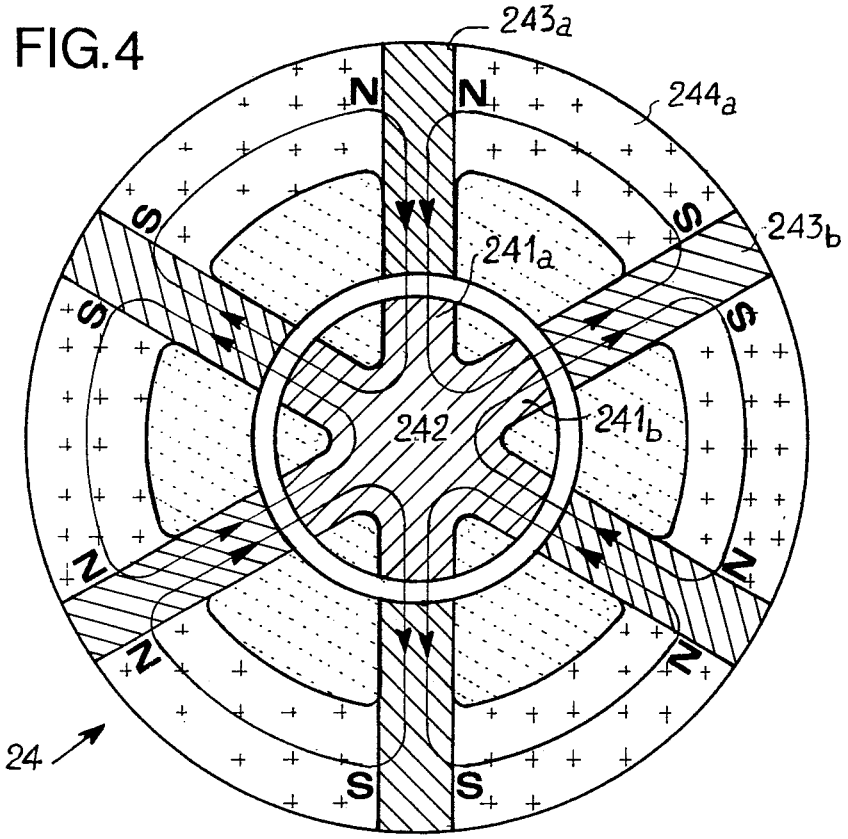
FIG. 4 is a cross sectional view of the magnetic clutch of the winder.

To render the structure mechanically possible, one is then led to the solution diagrammatically shown in FIG. 3*b*. The element 23' of the frame presents inside a hollow cylindrical surface; in this element 23' is held co-axially the rotor 22 by means of the bearings 223, 224 and it is the rotor 22 which holds co-axially the spindle 21 by means of the bearings 213, 214. The spindle 21 is immobilized from angular rotation relative to the frame element 23' by means of a magnetic clutch 24 shown in axial section in FIG. 3*b* and in radial cross section in FIG. 4.

This magnetic coupling or clutch 24, known per se, comprises a central member 241 and a peripheral member 243 both of revolution about a common geometric axis. These two members are separated by a gap 245 of uniform thickness and defining a frustrum of a cone to permit the passage of the wire F to describe the cone as aforesaid. In the embodiment shown in FIG. 4, the clutch 24 is divided into six equal sectors each correponding to a closed magnetic circuit shown by an arrow, one such sector comprising, for example, the radial teeth 243*a*, 243*b* of the peripheral member and the circumferential permanent magnet 244*a* (of polar faces N, S as shown) and the teeth 241*a*, 241*b* of the central member converging on a central hub 242. The teeth such as 241*a*, 243*a* and the magnets such as 244*a* are of magnetic material; non-magnetic material makes up the remainder of each sector and this is formed so that the opposed surfaces defining gap 245 are smooth to ensure an easy sliding of the wire as it passes through the gap.

Figure 5:
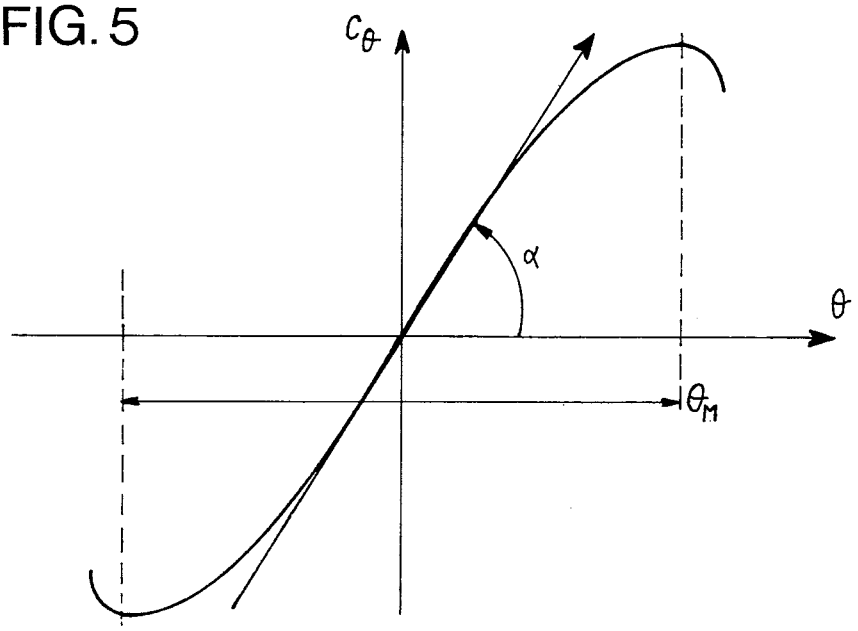
FIG. 5 is a representative diagram of variation of the magnetic couple $C_\theta$ brought about by the clutch of FIG. 4 according to the angle of sliding $\theta$.

A mechanical couple exercised on the spindle is transformed into an angular shift $\theta$ between members 241, 243 of the clutch and therefore there is set up an oppositely acting magnetic couple $C_\theta$ tending to balance the preceeding one. Next, couple $C_\theta$ varies according to $\theta$ as indicated in FIG. 5, its maximum value securing at $\theta_M$ corresponding to an angular half pitch of the teeth of the clutch. The stiffness of the connection between 241 and 243 is given by the slope tan $\alpha$ of the tangent through the origine of the curve $C(\theta)$. This stiffness, as well as the inertia of the spindle, brings about the existence of a natural frequency of vibration which must be taken into account to prevent the production of a resonance phenomena.

Figure 3C:
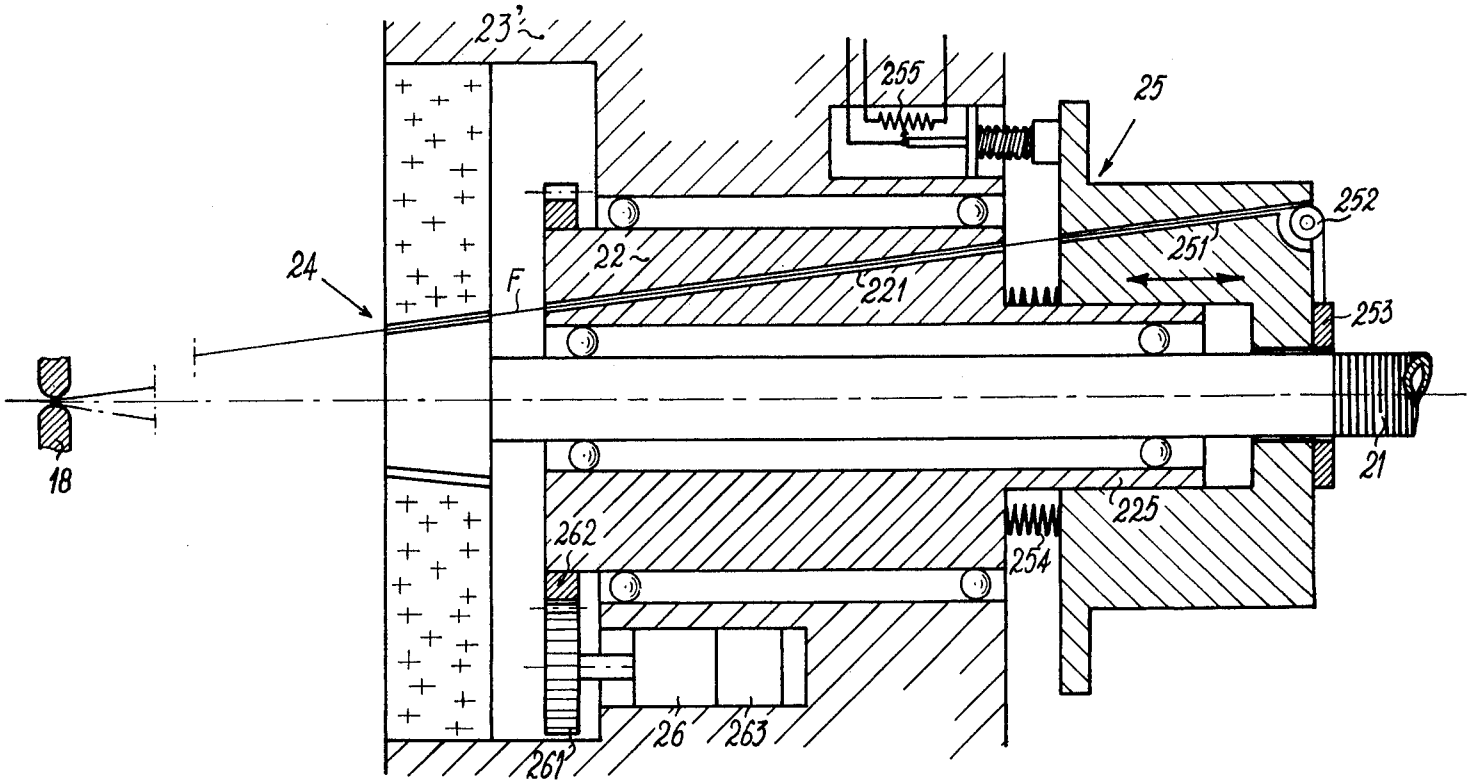

Actually (see FIG. 3*c*) and for reasons which will be seen later, the rotor 22 of the winder has its front part constituted by a nose piece 225 of reduced diameter on which is mounted a winding head 25 keyed with respect of the rotor 22 so as to rotate therewith by means of a pin (not shown) so that a wire passing through channel 251 of this head is in an aligned extension of the aforementioned channel 221 in the rotor (the aforementioned return pulley 222 being eliminated and its function served by pulley 252 on the front of the head), this head being, however, deflectable in axial direction relative to rotor 22 (as the double arrow of FIG. 3*c* indicates). The head 25 carries on its front end a section of a helicoidal ramp 253 and the section is substantially equal to the diameter of the wire to be wound. This ramp section is known per se and it has the object of winding the wire on the spindle and pushing each turn produced behind those already formed. The force of the action exercised on the head by the wave guide already formed is opposed to that created by three compression springs 254 (only two are shown in FIG. 3*c*) regularly distributed around the head. The effective recoil of the head is measured by a position detector 255 constituted for example by an axially directed linear potentiometer having a high resolution, the slide of which is carried by the head 25. The signal measuring the position of the head 25, supplied by the detector 255, is utilised in a control system which will be described later.

To complete the description of the winder, it suffices to indicate that the rotor 22 is driven by a motor 26 by means of a reduction gearing 261, 262. On the shaft of the motor 26 is keyed a tachometer generator 263 the signal of which measures the speed of the motor 26 and is utilised in the aforementioned system of control of the machine.

Figure 6:
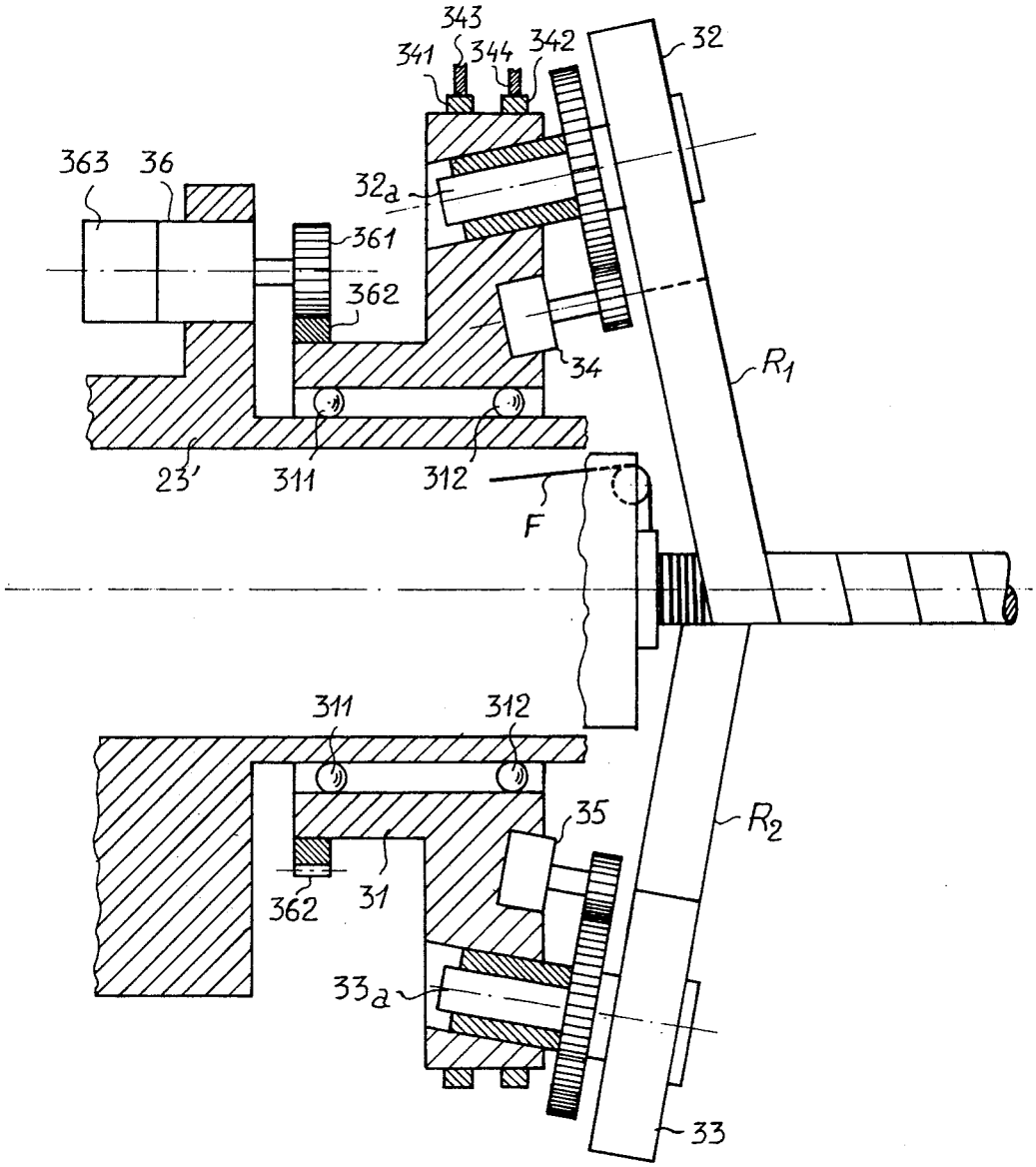
FIG. 6 is a diagrammatic view of the ribbon winder.

The ribbon winder III (see FIG. 6) is essentially for applying ribbon to the waveguide in the course of the winding of the turns thereof as it advances on the spindle. The ribbon winder comprises a body 31 mounted for turning on the aforementioned frame element 23' and co-axial with the winder II. The body is rotatable on bearings 311, 312. The body 31 carries two feed bobbins 32, 33 providing adhesive ribbons R1, R2 for outer protection of the guide, these bobbins being mounted in diametrically opposite positions on the rotative body 31, and being rotatable respectively about two inclined axles 32*a,* 33*a,* the inclination being dictated by the common width of the ribbons because each ribbon is wound so that the coils thereof are placed edge-to-edge without gaps therebetween or over-lapping, each coil of the first ribbon being overlapped by a coil by the second ribbon displaced by a half width of ribbon. The two bobbins 32, 33 are provided with two electromagnetic power brakes 34, 35 respectively having the object of creating a tension in each of the ribbons. If no precaution were taken, the tension would vary with the degree of unwinding, that is with the outer diameter of each bobbin. This tension is made constant by causing the feed current of the electromagnetic brakes to vary according to the number of unwinding turns of the bobbin. This feeding of the brakes is effected by means of electric conductors such as 341, 342 and corresponding line contacts such as 343, 344.

To complete the description of the ribbon winder, it suffices to indicate that the rotating body 31 is driven by motor 36 by means of reduction gearing 361, 362. On the shaft of the motor 36 there is keyed a tachometric generator 363, and the signal (the speed of the motor 36) therefrom is utilised in the aforementioned system of control of the machine.

Figure 7:
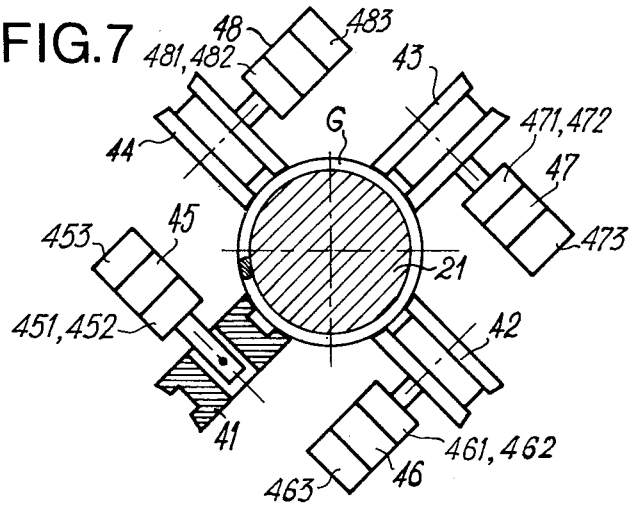
FIG. 7 is a diagrammatic view of the capstan driver.

The capstan driver IV (see also FIG. 7) is for exercising on the guide section already formed between it and the winder, a reaction force opposing the thrust exercised by the winder, a thrust which is thus practically cancelled in the portion of the guide having passed the capstan driver, whilst permitting the advance of the guide in the course of its formation.

The capstan driver has also for its object to support and center the spindle which, otherwise, would be overhanging. To do this, the capstan driver comprises a certain number of rollers regularly distributed around the spindle 21 covered by the guide G; these rollers are normally four in number 41–44; they are angularly spaced apart from one another by 90° and their axes are all inclined at 45° to the horizontal. The two lower rollers are fixed in position and the two upper ones resiliently applied against the guide.

To avoid the complication which the existence of mechanical differentials between the four rollers would entail if they were operated by a single motor, the rollers respectively are provided with individual motors 45–48 and these motors are supplied in series to constitute an electric differential so that a reduction of pressure of one of the rollers on the guide which causes an acceleration of this roller will entail automatically a compensating slowing down of the other rollers.

Each of the four rollers is provided with a rubber band so that the pressures exercised by the two active edges of the corresponding rim are equalized and each is driven by a motor respectively 45 to 48 by means of a universal joint and a reduction gearing such as 451, 452. Finally, on each motor such as 46 there is keyed a tachometric generator 463 and the four tachometric generators are mounted in series so that ths single output signal supplied by these tachometric generators which is utilised in the aforementioned system of control of the machine is representative of the average angular speed of the rollers.

Figure 8:
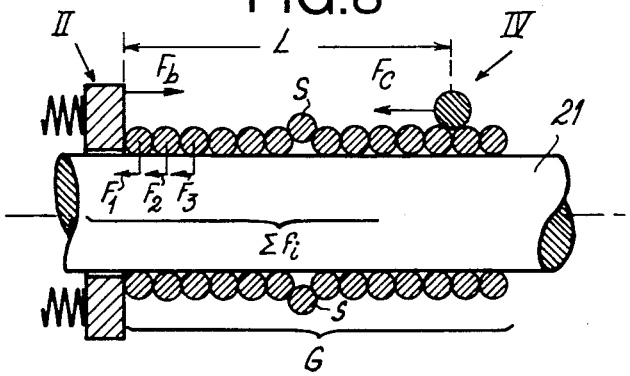
FIG. 8 is a diagram of the forces acting on the wave-guide section between the winder and the capstan driver.
Figure 9:
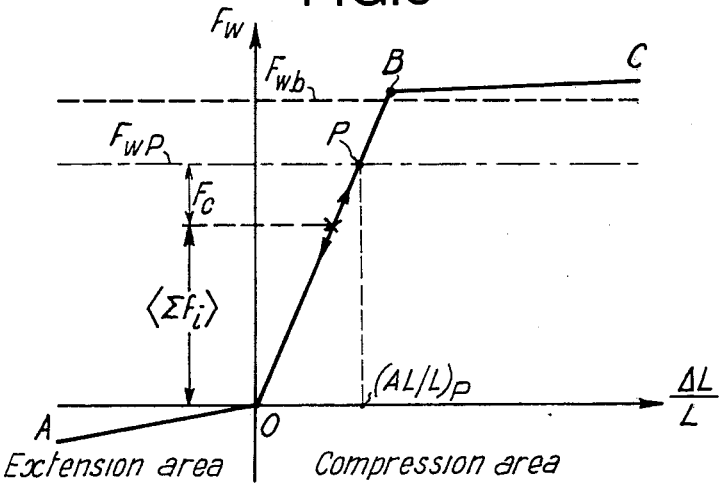
FIG. 9 is a representative diagram of variation of the thrust force $F_b$ exercised by the winder according to the relative variation of length of the guide section vbetween the winder and the capstan driver.

It is now proposed to describe the control system of the machine, making use first of all of the diagram of FIG. 8 and of the diagram of FIG. 9.

In the diagram of FIG. 8, there is shown in longitudinal section the spindle 21 and the guide section G formed of winding turns placed edge-to-edge on this spindle and included between the winder II and the capstan driver IV. The ribbon sheath is not represented. In the course of manufacture of the guide, the section G is constantly being formed due to the fact that the winding turns advance in the course of their formation in a movement of translation in axial direction, going from the left to the right of FIG. 8, by sliding on the spindle 21. At a given instant, the forces to which the guide section G is subjected are the following:

a thrust force $F_w$ exercised by the winder II a normally opposing force $F_c$ exercised by the capstan driver IV frictional forces of the winding turns on the spindle having axial components $f_1, f_2, \ldots$ of total $\Sigma f_i$ acting in opposite direction to $F_w$.

Therefore, in order that the guide may be displaced on the spindle, it is necessary that one should have:

$$F_w = F_c + \Sigma f_i$$

In the diagram of FIG. 9, there is shown the variation of the force $F_w$ according to the deformation due to compression $\Delta L/L$ of the guide section G included between the winder and the capstan driver. The representative curve of this variation substantially comprises three right segments. The first segment AO represents the case where $\Delta L < O$, that is the extension of the guide section. As the windings of copper wire have a very weak extension elasticity, the segment OA is of very slight slope. The two following segments OB, BC, represent the case where $\Delta L > O$, that is the compression of the guide section; the guide section G presents, first of all, at OB, a notable stiffness to the crushing of the winding turns one against the other which causes the segment OB to have a large slope; there is however a limit value $F_{wb}$ beyond which the said stiffness breaks down, and winding turns such as S spring from alignment with the adjacent winding turns to provide overlapping and collapse which are very undesirable; the segment BC has a slight slope.

As has been seen above, the thrust force $F_w$ of the winder must be substantially, at each instance, equal to the sum of the reaction force $F_c$ of the capstan driver and of the force $\Sigma f_i$ due to the friction of the winding turns on the spindle (note that the capstan driver does not pull the waveguide section but instead pushes it). Now this second term $\Sigma f_i$ is variable; it depends on the nature and the state of the surfaces in mutual contact, of the pressure of this contact, of the speed of displacement of the winding turns on the spindle, etc. From this latter point of view, the frictional force is relatively strong at nil speed (static friction); then it is a decreasing function of speed up to a minimum, and finally becomes an increasing function of the speed. The term of friction $\Sigma f_i$ being imperfectly known is shown in the diagram by an average value $<\Sigma f_i>$ and can fluctuate to a certain extent as the double arrow indicates. One chooses, consequently, as the point of operation on the segment OB, a point P near the mid-distance of the two horizontals corresponding the one to $<\Sigma f_i>$ (average friction), and the other to $F_{wb}$ (collapse), thus retaining a satisfactory security in respect of these two limits. This point of operation is located in the full zone of compression, a necessary condition to obtain a guide having satisfactory mechanical and electrical qualities, and determines the thrust force $F_w$ to be exercised by the winder. The reaction force $F_c$ of the capstan driver must result therefrom by the difference $F_w - \Sigma f_i$ subject to this reaction force not becoming too weak because then the guide would become too dependent on the forces of friction and it would be necessary in this case to increase $F_w$, or alternately to increase the speed of advancement of the guide which results in decreasing $\Sigma f_i$, which is scarcely compatible with a stable operation of the machine.

Summing up, it is necessary that the reaction force $F_c$ exercised by the capstan driver be sufficiently related to the thrust force $F_w$ given by the winder taking into account the fluctuations of the friction forces so that:

a. on the one hand, the section of waveguide G located between the winder and the capstan driver be kept constantly under compression in spite of the variation of the friction force;

b. on the other hand, the distance between the winder and the capstan driver (distance whose variation is $\Delta L$) be kept substantially constant in order the compression be kept within a narrow range.

The control system of the machine comprises:

a speed control 20 of the winder (FIG. 10) from a control voltage $V_{201}$;

a speed control 30 of the ribbon winder (FIG. 11) from that of the winder taken as reference;

a speed control 40 of the capstan driver (FIG. 12) from the winder speed but corrected as will be seen by a device ensuring the equality of the waveguide length wound by the winder and the waveguide length driven by the capstan driver.

The speed control 20 of the winder is very simple. It comprises a potentiometer 201 supplying a control voltage $V_{201}$, a comparator 202, an amplifier 203 supplying the necessary power for the driving of the motor 26 of the winder, the tachometric generator 263 supplying a voltage $V_{263}$ representative of the true speed of rotation of the winder. The comparator 202 supplies an error voltage $V_{202} = V_{201} - V_{263}$ the weaker the higher the gain of amplifier 203.

It is the voltage $V_{263}$ of the winder which is taken as reference voltage for the other networks of control 30 of the ribbon winder and control 40 of the capstan driver due to the fact that of the three parts of the machine, it is the winder which has the longest time constant.

The speed control 30 of the ribbon winder is also quite simple, but must be of very good performance. This speed must be regulated in a manner as precise as possible on the speed of rotation of the winder, taking into account the ratio of the width of the ribbon $R_1$, $R_2$ to the diameter of the wire F. This control comprises a comparator 302, an amplifier 303 supplying the necessary power for the driving of the motor 36 of the ribbon winder, the tachometric generator 363 supplying the voltage $V_{363}$ representative of the true speed of rotation of the ribbon winder. The comparator 302 supplies an error voltage $V_{302} = V_{263} - V_{363}$ the weaker the higher the gain of amplifier 303. It is the reducers 261/262 and 361/362 (see also FIG. 6) which take account of the ratio "width of ribbons/diameter of wire".

This servo-system, like the preceding one, is conventional, but it has high efficiency characteristics from the point of view of time constant (which must be as weak as possible) as well as from the point of view of precision, therefore of gain of the chain. The amplifier 303 and the consecutive mechanical chain are adapted to avoid the drawbacks due to variations of the driving couples of the ribbon winder caused by the variations of the diameter of the bobbins in the course of unwinding of the latter. In spite of these precautions, there would always continue to be a small error of speed which would entail the winding of each ribbon either in overlapping relationship, or with spacing if one did not have available in addition a fine correction potentiometer 301 supplying a voltage $V_{301}$ supplied also to the comparator 302 which gives $V_{302} = V_{263} - V_{363} - V_{301}$. This fine correction of the speed necessitates obviously a permanent supervision of the operation of the machine.

The control 40 of the capstan driver must comply with the two conditions already mentioned, namely to ensure on the one hand the equality of the length of the guide wound and driven and on the other hand the keeping in compression of the guide section G included between the winder and the capstan driver. This control comprises an adder 402 which is nothing other than an operational amplifier effecting the algebraic sum of all the voltages which are applied to it, an amplifier 403 supplying the power necessary for the driving of the motors 45–48 of the capstan device (only motor 46 is represented in FIG. 12) and the tachometric generators 453, 463, 473, 483 (only tachometric generator 463 is represented in FIG. 12) supplying a voltage $V_{463}$ representative of the true speed of rotation of the capstan driver. The adder 402 which receives the voltage $kV_{263}$ proportional to $V_{263}$ supplies an error voltage $V_{402}$. This control however, is insufficient to effect the satisfaction of the two conditions mentioned above. In fact, the least error of speed of the capstan driver is integrated with respect to time to give an error of length, resulting in a displacement of the point of operation P of FIG. 9 such that it causes either a collapse or an extension of the coil which is incompatible, as has already been stated, with the production of a quality waveguide.

To avoid this, a correction loop controlled by the variation $\Delta L$ between the coil wound length and the coil driven length is used. The variation $\Delta L$ which is nothing else that the shift of the winder head 25 is equal to the integral of the difference between the speed of the motor of the winder and the speed of the motor of the capstan driver. The quantity $\Delta L$ is sensed by a position sensor 255 giving a voltage $V_{255}$. This voltage $V_{255}$ is equal to zero when $\Delta L/L$ has the value $(\Delta L/L)_P$ shown in FIG. 9.

The voltage $V_{255}$ is amplified by amplifier 256 and the output signal $k'V_{255}$ of amplifier 256 is applied to the input of algebraic adder circuit 402. The total voltage applied to adder 402 is thus:

$$kV_{263} = V_{463} + k'V_{255} \quad (1)$$

Since $$V_{255} \alpha \int (aV_{263} - bV_{463})\, dt$$

Then, expression (1) becomes $$kV_{263} + ak' \int V_{263}dt - V_{463} - bk' \int V_{463}dt \quad (2)$$

where *a, b, k, k'* are constant.

The control of speed of the capstan driver solely from the position of the winding head would meet with great dynamic difficulties. That is the reason why it is preferred to rough down the control of the speed of the capstan driver motor by a first control chain from the speed of the winder, and to correct the speed obtained of the capstan driver motor by a second control chain from the position of the winder head.

What I claim is:

1. A rotating winding machine for the continuous manufacture of a circular waveguide by the winding of an insulated metal conductor in the form of a wire around a spindle comprising:

an elongated frame for supporting a rotatable winder member;

a winder member for winding of said insulated conductor which is rotatably mounted within said frame having a longitudinal axis of rotation;

said rotatable winder member having an axial bore for passage of a spindle and a channel inclined with respect to the axis of rotation of said winder for the passage of a continuous length of said wire through said channel from a supply reel;

a wire tensioning device supplying said wire to said channel under a predetermined tension;

a wire guide means for said wire tensioning device to guide the wire at the intersection of the channel and the longitudinal axis of said winder member;

spindle having a first cylindrical portion centered in said axial bore of said rotatable winder member and a second cylindrical portion extending beyond said rotatable winder member in the direction opposite to said wire tensioning device and about which said wire is wound inside by side abutting relation;

spindle-support means for fixing said first cylindrical portion of said spindle with respect to said frame while allowing passage for said wire;

motor means to drive said winder member for winding around said second cylindrical portion of said spindle the length of wire continuously emerging from said inclined channel, the already formed turns of wire about, said second cylindrical portion being thus pushed in said direction by said length of wire;

capstan driver means bearing against said second portion of said spindle for supporting said second portion and applying to said already formed turns a compression stress in the direction of said rotatable winder member;

additional motor means for driving said capstan driver means and control means for controlling said additional motor means, said control means comprising an axially movable winder head which is mounted in said rotatable winder member, sensing and signalling means for detecting the axial position of said winder head with respect to said frame and providing a winder head position signal and means for controlling said additional motor means responsive to said winder head position signal, whereby the capstan driver movement cooperates in maintaining a compression stress on said already formed turns.

2. A rotating winding machine for the continuous manufacture of a circular waveguide by the winding of an insulated metal conductor in the form of a wire around a spindle comprising:

an elongated frame for supporting a rotatable winder member;

a winder member for winding of said insulated conductor which is rotatably mounted within said frame having a longitudinal axis of rotation;

said rotatable winder member having an axial bore for passage of a spindle and a channel inclined with respect to the axis of rotation of said winder member for the passage of a continuous length of said wire through said channel from a supply reel;

a wire tensioning device supplying said wire to said channel under a predetermined tension;

a wire guide means for said wire tensioning device to guide the wire at the intersection of the channel and the longitudinal axis of said winder member;

a spindle having a first cylindrical portion centered in said axial bore of said rotatable winder member and a second cylindrical portion extending beyond said rotatable winder member in the direction opposite to said wire tensioning device and about which said wire is wound in side by side abutting relation;

spindle-support means for fixing said first cylindrical portion of said spindle with respect to said frame while allowing passage for said wire;

motor means to drive said rotatable winder member for winding around said second cylindrical portion of said spindle the length of wire continuously emerging from said inclined channel, the already formed turns of wire about said second cylindrical portion being thus pushed in said direction by said length of wire;

capstan driver means bearing against said second portion of said spindle for supporting said second portion and applying to said already formed turns a compression stress in the direction of said rotatable winder member;

a rotatable ribbon winder member, a ribbon supply furnishing adhesive ribbon to said ribbon winder member and a ribbon winder driving motor to rotatably drive said ribbon winder and control means for controlling said ribbon winder driving motor, said control means comprising sensing and signalling means providing a signal indicating the speed of said motor means driving said rotatable winder member and means for controlling said ribbon winder driving motor responsive to said signal.

* * * * *